United States Patent [19]

Anhalt et al.

[11] Patent Number: 4,950,172

[45] Date of Patent: Aug. 21, 1990

[54] CONNECTOR WITH INTERCEPTOR PLATE

[75] Inventors: John W. Anhalt, Orange; Edward Rudoy, Woodland Hills; William J. Clark, Mission Viejo; Michael A. Lin, Anaheim, all of Calif.

[73] Assignee: ITT Corporation, New York, N.Y.

[21] Appl. No.: 419,405

[22] Filed: Oct. 10, 1989

[51] Int. Cl.[5] ..... H01R 13/648

[52] U.S. Cl. ..... 439/108; 439/69; 439/607

[58] Field of Search ..... 439/92, 108, 607, 69

[56] References Cited

U.S. PATENT DOCUMENTS

| | | | |
|---|---|---|---|
| 4,070,084 | 1/1978 | Hutchison | 339/143 |
| 4,148,543 | 4/1979 | Shores | 339/143 |
| 4,232,929 | 11/1980 | Zobawa | 339/143 |
| 4,386,814 | 6/1983 | Asick | 339/14 |
| 4,407,552 | 10/1983 | Watanabe et al. | 339/143 |
| 4,418,972 | 12/1983 | Benasutti | 439/607 |
| 4,511,196 | 4/1985 | Schuler et al. | 339/14 |
| 4,550,960 | 11/1985 | Asick et al. | 339/14 |
| 4,552,420 | 11/1985 | Eigenbrode, deceased | 339/14 |
| 4,571,014 | 2/1986 | Robin et al. | 339/14 |
| 4,601,527 | 7/1986 | Lemke | 339/14 |
| 4,616,893 | 10/1986 | Feldman | 339/14 |
| 4,619,494 | 10/1986 | Noorily et al. | 339/103 |
| 4,632,476 | 12/1986 | Schell | 339/14 |
| 4,634,199 | 1/1987 | Anhalt et al. | 439/69 |
| 4,641,901 | 2/1987 | Brennan et al. | 339/14 |
| 4,653,837 | 3/1987 | Phillipson et al. | 339/143 |
| 4,653,840 | 3/1987 | Grabbe et al. | 339/177 |
| 4,655,515 | 4/1987 | Hamsher, Jr. et al. | 339/14 |
| 4,687,267 | 8/1987 | Header et al. | 439/62 |
| 4,695,106 | 9/1987 | Feldman et al. | 439/83 |
| 4,708,412 | 11/1987 | Himes, Jr. et al. | 439/95 |
| 4,726,638 | 2/1988 | Farrar et al. | 439/620 |
| 4,731,031 | 3/1988 | Lemke | 439/96 |
| 4,743,080 | 5/1988 | Siraty | 439/492 |
| 4,747,787 | 5/1988 | Siwinski | 439/108 |
| 4,752,231 | 6/1988 | Olsson | 439/66 |
| 4,761,147 | 8/1988 | Gauthier | 439/607 |
| 4,773,878 | 9/1988 | Hansell III | 439/92 |
| 4,789,358 | 12/1988 | Zell et al. | 439/607 |
| 4,806,109 | 2/1989 | Manabe et al. | 439/108 |
| 4,806,110 | 2/1989 | Lindeman | 439/108 |

OTHER PUBLICATIONS

ITT-Cannon Electrical Connector Pin Header Drawings, #098472-0000 and 098472-0001.

*Primary Examiner*—Gary F. Paumen

*Attorney, Agent, or Firm*—Thomas L. Peterson

[57] ABSTRACT

A connector is provided of the type that has rows of contacts, which minimizes cross talk between adjacent contacts. An interceptor plate (60, FIG. 2) which is grounded or at another controlled potential, extends along each row of contacts (34), the plate lying close to the row to provide better capacitive coupling between each contact and the plate than between contacts of the same or different rows.

3 Claims, 5 Drawing Sheets

FIG. 4
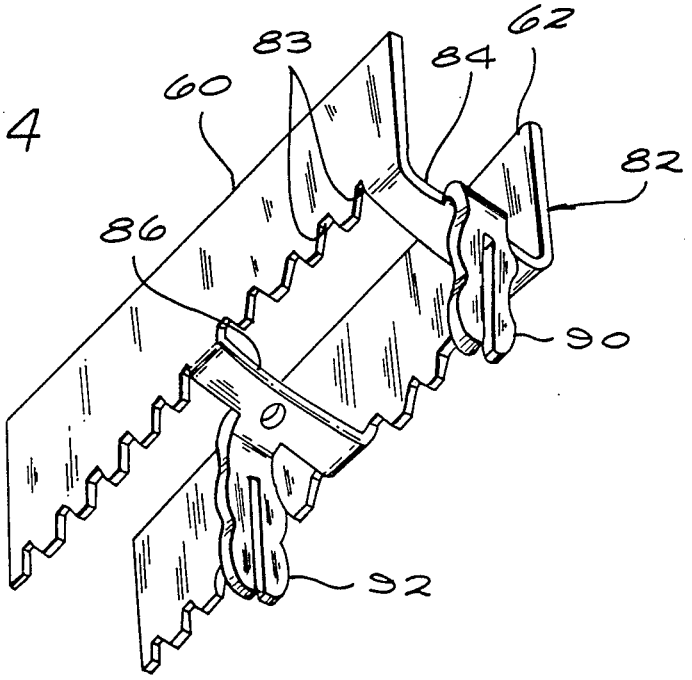
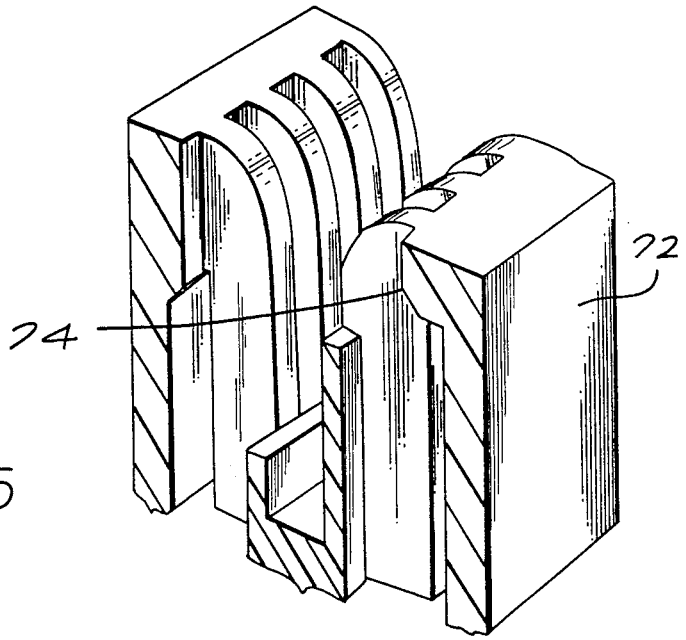
FIG. 5

FIG. 8
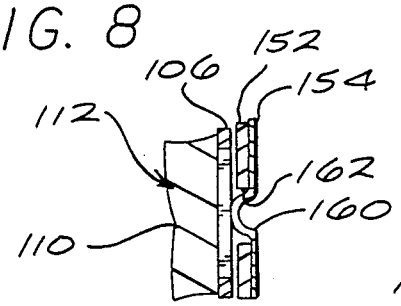
FIG. 9
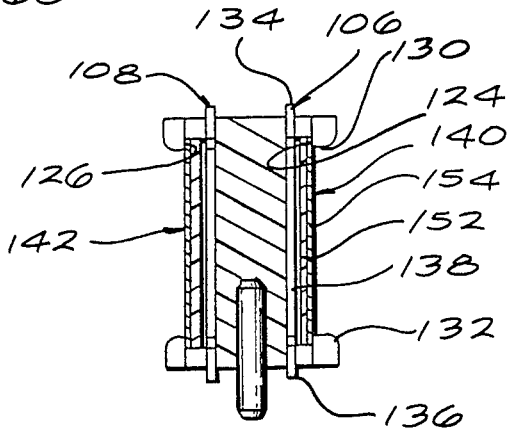
FIG. 10
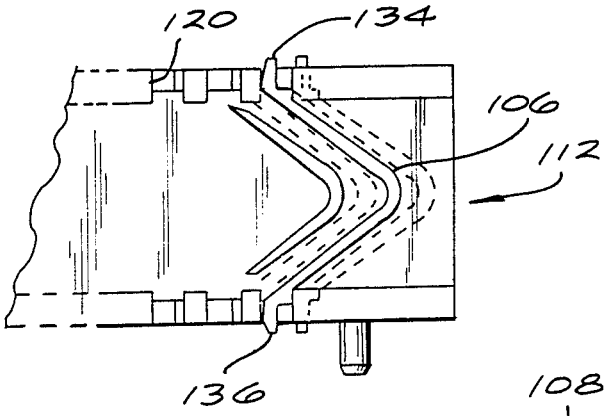
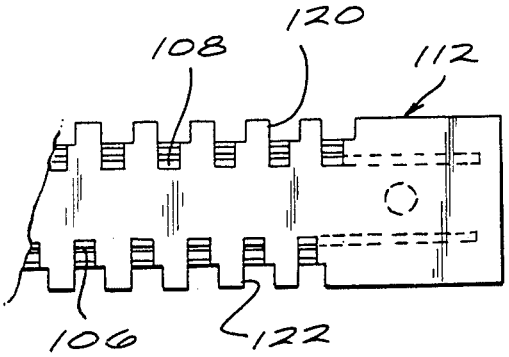
FIG. 11

CONNECTOR WITH INTERCEPTOR PLATE

BACKGROUND OF THE INVENTION

As clock speeds of electrical systems increase, attention has to be paid to connectors that connect circuit boards to one another or to other peripherals, in order to prevent signal degradation at the connectors. Cross talk between adjacent contacts can be a problem. Connectors often include two parallel rows of contacts. One prior art approach is to embed a grounded plate halfway between two rows of contacts in insulation lying between the contacts. Such a grounded plate reduces cross talk, but not sufficiently for high speed circuits. A connector which greatly reduced cross talk between contacts as well as outside interference would be of considerable value.

SUMMARY OF THE INVENTION

In accordance with one embodiment of the present invention, a connector with at least one row of contacts is constructed to greatly isolate the contacts from one another to prevent cross talk between adjacent contacts as well as to avoid outside interference. In a connector with two rows of contacts, wherein each contact has a mounted part held on a mount and an elongated leg, and wherein the legs of a row of contacts all lie substantially coplanar, an interception plate is provided to minimize cross talk The interception plate, which is maintained at a controlled constant potential, extends along a plane that is close to and parallel to the plane of the contact legs. With two rows of contacts, two interception plates are provided that lie outside the space between the two rows of contacts. Each interceptor plate is close enough to a contact leg, and preferably to a face of a strip shaped contact leg, so there is a large area of the contact leg facing the plate, and there is much better capacitive coupling between the plate and each contact than between adjacent contacts.

The novel features of the invention are set forth with particularity in the appended claims. The invention will be best understood from the following description when read in conjunction with the accompanying drawings.

BRIEF DESCRIPTION OF THE DRAWINGS

FIG. 4 is a bottom isometric view of an interceptor of the connector of FIG. 1.

FIG. 5 is a partial isometric view of the housing insulator of FIG. 2.

FIG. 8 is a partial sectional view taken on line 8—8 of FIG. 7.

FIG. 9 is a sectional view of the connector of FIG. 7.

FIG. 10 is a partial side elevation view of the connector of FIG. 7.

FIG. 11 is a partial plan view of the connector of FIG. 7.

DESCRIPTION OF THE PREFERRED EMBODIMENTS

Figure 1:
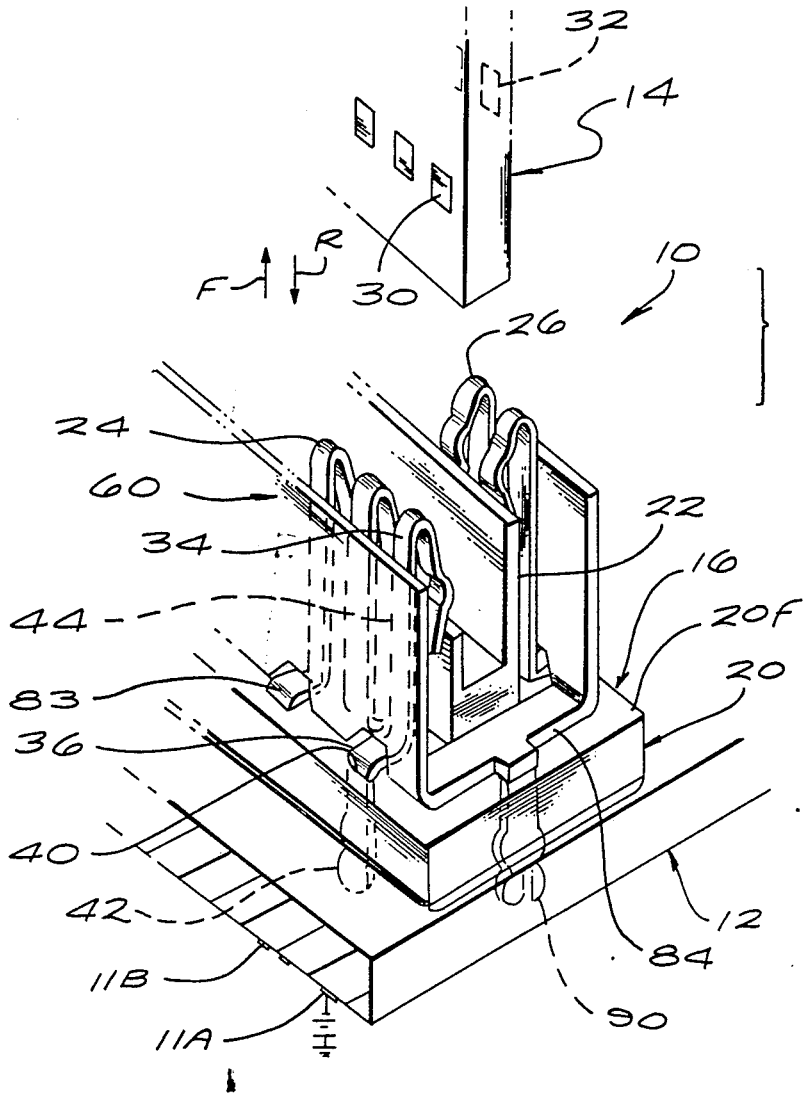
FIG. 1 is a partial isometric view of a connector of one embodiment of the invention, shown without the insulation in place, and showing how it is used with two perpendicular circuit boards.
Figure 3:
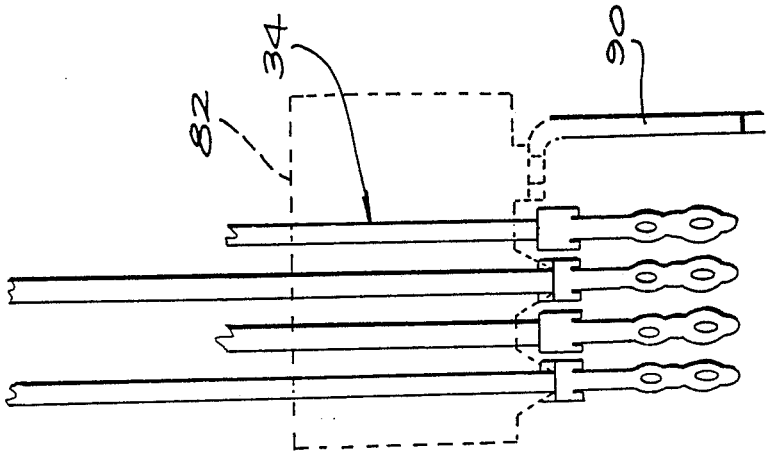
FIG. 3 is a partial side elevation view of the connector of FIG. 1.

FIG. 1 illustrates a connector 10 which is used to connect conductors such as 11A, 11B on first and second circuit boards 12, 14. The connector has a housing 16 that includes a support 20 held on the first circuit board 12. The housing also includes a board or card end receiver 22 that is held on the support and that receives the second circuit board 14 to a final position against a rear face of the receiver. The connector includes first and second rows of contacts 24, 26 for contacting rows of conductive pads 30, 32 on the second circuit board.

Figure 2:
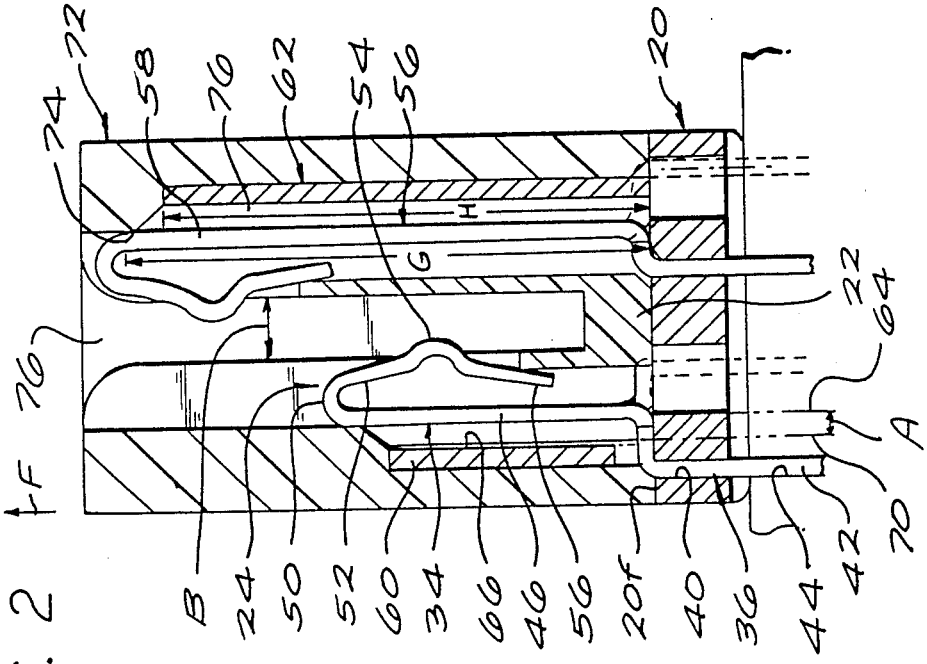
FIG. 2 is a sectional view of the connector of FIG. 1, but with the. housing insulator in place.

As shown in FIG. 2, each contact such as 34 includes a mounted part 36 that extends along the front face 20*f* the support 20 and closely through a hole 40 in the support. In this system, the mount part has a rearward end 42 that is electrically connected and fixed to a plated-through hole 44 in the first circuit board. Each contact also has an elongated leg 46 that extends forwardly, in the direction of arrow F, from the mounted part 36. The contact has a substantially 180° loop 50 at the forward end of the leg, and has a reverse arm 52 extending largely rearwardly from the loop, the reverse arm having a protrusion 54 for contacting a pad on the second circuit board. The reverse arm also has a rearward end 56 that bears against a side of the receiver 22. Each contact such as 56 of the second row is similar, except that its leg 58 is longer.

In accordance with the present invention, the connector includes a pair of interception plates 60, 62 that minimize cross talk between each contact and adjacent contacts of the same or other row. The elongated legs such as 46 of the contacts in a row such as 24 all lie substantially in a common imaginary plane 64. The contacts such as 34 are formed from strips of metal having a greater width than thickness, and the plane 64 lies at the faces of the contact legs that are closest to the interception plate 60. The plate 60 has an inner face 66 that lies in an imaginary plane 70 that is parallel to the plane 64 of the contact legs. The distance A between adjacent faces of the contact legs and interception plate is small, so there can be close capacitive coupling of the interception plate with the contact leg of each contact of a row of contacts.

Figure 6:
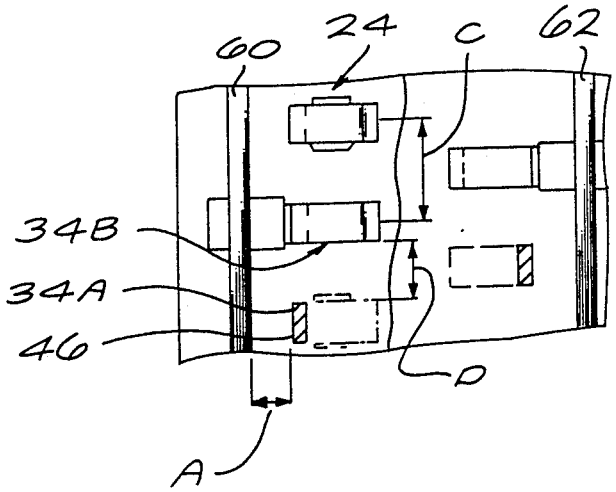
FIG. 6 is a partial plan view of the connector of FIG. 1.
Figure 7:
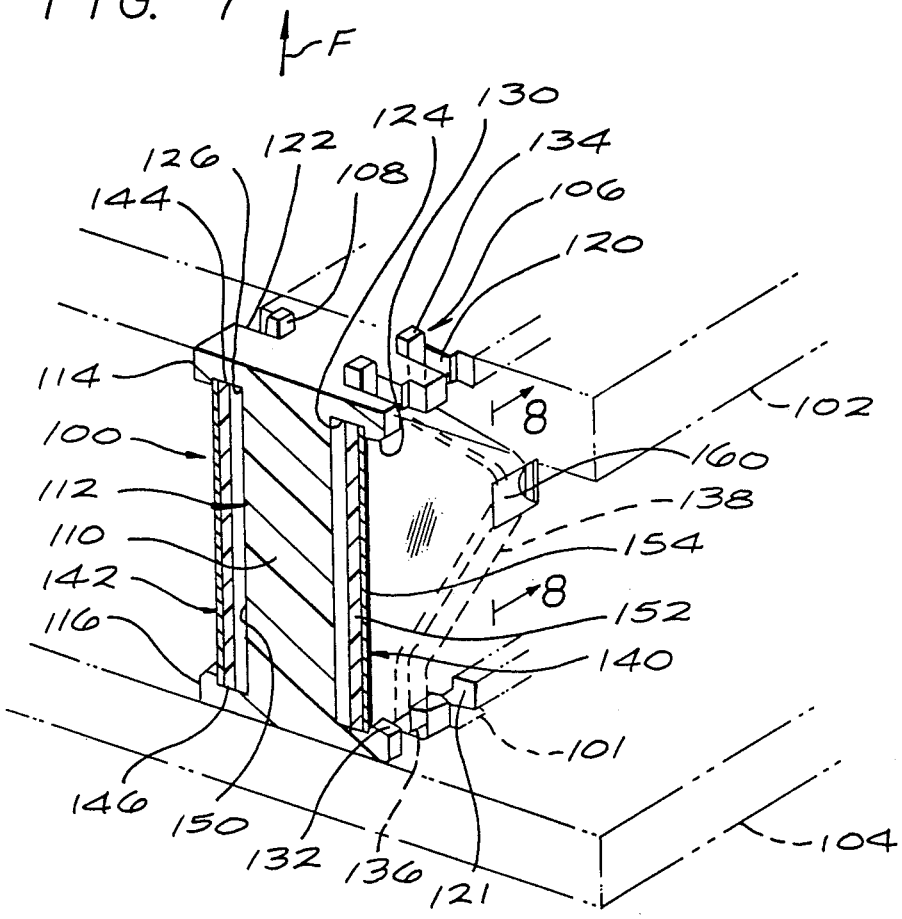
FIG. 7 is a partial isometric view of a connector constructed in accordance with another embodiment of the invention.

The distance A between the interceptor plate and the contact legs is less than the distance B between adjacent rows of contacts when the two rows of contacts engage the second circuit board. Also, as shown in FIG. 6, the distance A is less than the row spacing distance C by which contacts in the row 24 are spaced apart. In fact, the distance A is preferably no more than the distance or length D of the gap between adjacent contacts 34A, 34B. Even if the distances A and D were equal, there would be closer coupling between each contact leg 46 and an adjacent interceptor plate 60 because the adjacent faces of the plate and leg 46 have greater areas than the adjacent surfaces of the two contacts 34A, 34B.

As shown in FIG. 2, the height H of each interception plate such as 62 is more than half the height G of the adjacent contact leg 58. The connector housing includes an insulator 72 with a location 74 that backs the forward end of the contact leg to limit its deflection away from the region 76 where the second circuit board is received. The interception plate such as 62 extends slightly below this insulator location 74 so that the space 76 between each contact leg and interception plate can be substantially empty. That is, the space 76 is substantially devoid (at least 90% of the space is empty) of solid material including insulation. By providing a substantially empty space between the plate and contact leg, applicant avoids degradation of capacitive coupling that would result from the presence of (solid) material in the space.

Applicant prefers that the height H of the plate be at least about 75% and preferably at least 90% of the height G of the contact leg 58. The fact that the contact legs are substantially coplanar allows the relatively simple interception plate to lie facewise close to the large areas of all contacts of the adjacent row. The interception plates also provide shielding against radio frequency interference although this is a secondary consideration.

As shown in FIG. 4, the interception plates 60, 62 are parts of an interceptor 82 which is formed of a copper alloy for good electrical conduction. Each plate has recesses 83 in its rear edge, through which pass the mounted parts 36 of alternated contacts of a row. The interceptor includes bridges 84, 86 that connect the plates and that are integral with them. The bridges lie facewise adjacent to the upper surface **20*f* (FIG. 1) of the support. The interceptor has pins 90, 92 that pass through holes in the support and that engage plated-through holes in the first circuit board. The pins 90 are connected to a source of predetermined constant potential which may be a ground. Actually, applicant prefers to connect the pins and therefore all of the interceptor to a source which has a potential at least as low as or lower than the potential on any of the contacts that lie adjacent to either of the plates. Thus, in a computer system wherein the extreme voltages are +12 volts and −12 volts, and the signal pins carry high frequency signals that are between these voltages, applicant prefers to maintain the interceptor and its plates 60, 62 at a potential of no more than −12 volts, and preferably below that, such as −15 volts. By maintaining the interceptor plates at a voltage below that of any of the contacts, applicant sets up an appreciable electric field between each contact and the interceptor plate. This electric field influences adjacent magnetic fields so that magnetic fields around any contact carrying a high frequency signal do not extend with appreciable intensity to the vicinity of adjacent contacts, to avoid cross talk. In FIG. 1, the conductor 11A that connects to the interceptor pin 90**, is shown as at a voltage below ground.

FIGS. 7–11 illustrate a connector 100 that is useful for connecting conductive pads such as 101 of a pair of circuit boards 102, 104 that lie in parallel planes, and which may be any of a variety of boards such as where one is a display panel. This connector is of the basic type shown in U.S. Pat. No. 4,634,199. In this connector, two rows of contacts 106, 108 are provided, that lie in parallel planes on opposite sides of a central beam 110 on the housing 112. The housing has forward and rearward flanges 114, 116 at forward and rearward ends of the beam. Each flange forms a row of through holes 120, 122 at opposite sides of the beam, and a groove 124, 126 extending along a face 130, 132 of the flange which faces the other flange. Each contact, such as 106, has a pair of opposite mounted parts 134, 136 passing through a hole 120, 121 in the front and rear flanges, to be slideably mounted in the flanges. Each contact also has an elongated leg 138 connecting the mounted parts. Each of the contacts is a flat sheet metal part and is held adjacent to a side of the housing central beam by a pair of retainer strips 140, 142. Each retainer strip has front and rear edges 144, 146 lying in the front and rear grooves on one side of the central beam, to sandwich a row of contacts between the retainer such as 142 and a corresponding side 150 of the central beam.

In accordance with the present invention, each retainer strip such as 140 includes a strip 152 of dielectric material adjacent to a row of contacts, and a strip or thin plate 154 of electrically conductive material forming an interception plate. The two strips 152, 154 are preferably bonded together. The conductive strip or plate 154 is maintained at a predetermined constant potential, and provides close capacitive coupling to an adjacent row of contacts.

Applicant maintains each interception plate such as 154 at a predetermined constant potential by forming the plate with a contactor 160 that bears directly against a selected one of the contacts of a row of contacts such as 106. That particular contact 106 is positioned to touch a pad of one of the circuit boards that is at the desired potential such as ground or −12 volts. FIG. 8 shows the plate contactor 160 as provided by a deformed portion of the plate 154 which extends through a hole 162 in the strip 152 of dielectric material to press directly against the contact 106 which is backed by the central beam 110 of the housing.

In some applications, it is desirable to maintain the portion of the interception plate adjacent to one or several of the contacts of a row at a different potential than the portion of a plate that lies adjacent to other contacts of the same row. The two plate portions are electrically isolated. Applicant accomplishes this by interrupting the conductive strip or plate 154 so it has different portions that are electrically isolated from each other, and with each portion of the plate connected to a different contact that is at the selected potential for that plate portion.

Thus, the invention provides a connector with an interception plate which lies along the length of a row of contacts adjacent to the contact legs, where the legs have faces that all lie substantially in a single plane, to isolate each contact from the others to avoid cross talk, especially at high speed operation or high rate switching. The interception plate is at a controlled potential and lies close to a wide area of the contact legs to provide close capacitive coupling of the plate to the contact legs. The plate or selected portions thereof are each preferably of a potential considerably below that of the dc potential on adjacent contacts. In connectors with two rows of contacts, the plates are preferably located so two rows of contacts lie between the two plates, and without substantial insulation between each plate and an adjacent contact leg.

Although particular embodiments of the invention have been described and illustrated herein, it is recognized that modifications and variations may readily occur to those skilled in the art and consequently it is intended to cover such modifications and equivalents.

We claim:

1. A connector comprising:

a housing having a support;

first and second rows of contacts in said housing with each row of contacts including a mounted part in said support and an elongated leg extending in a predetermined forward direction from said mounted part, with the legs of the contacts in a row all lying substantially in an imaginary plane;

a pair of interception plates of electrically conductive material, each interception plate lying in a plane extending parallel to a said imaginary plane of a said row of contact legs, said interception plates lying on opposite sides of the space between said first and second rows of contacts, and said interception plates each lying closer to the contacts of an adjacent row of contacts than the distance between contacts in said first and second rows, and each interception plate having at least a portion adjacent to a plurality of said contacts and at a predetermined constant potential; and wherein said housing includes insulation between the contacts of a row and on a side of each plate opposite a corresponding row of contacts, but the space between each contact leg and an adjacent interception plate is substantially devoid of insulation.

2. A connector for connecting a pair of circuit boards lying in parallel planes, comprising:

a housing having a central beam with forward and rearward ends and forward and rearward flanges at said ends, each flange forming a row of through holes at opposite sides of said beam and forming a groove extending along a face of the flange which faces the other flange;

a pair of rows of contacts each having a pair of opposite mounted parts passing slideably through a hole in said front and rear flanges respectively, each contact having an elongated leg connecting said mounted parts;

a pair of retainer strips that each has front and rear edges lying in the front and rear grooves on one side of said central beam and sandwiching a row of contacts between itself and the central beam;

each of said retainer strips includes a strip of dielectric material adjacent to one of said rows of contacts and a strip of electrically conductive material at a predetermined constant potential on a face of said dielectric strip that is opposite the adjacent row of contacts.

3. The connector described in claim 2 wherein:

at least one of said strips of dielectric material has a hole therein, and the corresponding strip of conductive material forms a contactor that projects through the hole and bears against one of said contacts.

* * * * *